US007473183B2

(12) United States Patent
McDuffee

(10) Patent No.: US 7,473,183 B2
(45) Date of Patent: Jan. 6, 2009

(54) PORTABLE GOLF PUTTING PRACTICE KIT

(76) Inventor: Ruthann Angela McDuffee, N. 7339 17th Ave., New Lisbon, WI (US) 53950

( * ) Notice: Subject to any disclaimer, the term of this patent is extended or adjusted under 35 U.S.C. 154(b) by 0 days.

(21) Appl. No.: 11/891,571

(22) Filed: Aug. 10, 2007

(65) Prior Publication Data

US 2008/0020855 A1 Jan. 24, 2008

Related U.S. Application Data

(63) Continuation of application No. 11/283,432, filed on Nov. 19, 2005, now Pat. No. 7,258,621.

(60) Provisional application No. 60/690,233, filed on Jun. 14, 2005.

(51) Int. Cl.
*A63B 69/36* (2006.01)

(52) U.S. Cl. ..... 473/162; 473/166

(58) Field of Classification Search ..... 473/157–163, 473/166, 184

See application file for complete search history.

(56) References Cited

U.S. PATENT DOCUMENTS

| | | | | | |
|---|---|---|---|---|---|
| 1,722,028 | A | * | 7/1929 | Baack | 473/184 |
| 1,952,187 | A | * | 3/1934 | Ripley | 473/158 |
| 3,540,733 | A | * | 11/1970 | Lamattina | 473/153 |
| 3,990,573 | A | * | 11/1976 | Cross | 190/115 |
| 4,017,084 | A | * | 4/1977 | Jeffery | 473/162 |
| 4,344,624 | A | | 8/1982 | Laursen | |
| 4,368,888 | A | | 1/1983 | Ren | |
| 4,953,865 | A | | 9/1990 | Coombs et al. | |
| 5,007,644 | A | | 4/1991 | Bluthardt et al. | |
| 5,242,169 | A | * | 9/1993 | Laabs et al. | 473/184 |
| 5,429,368 | A | | 7/1995 | Adams | |
| 5,586,941 | A | | 12/1996 | Klearman | |
| 5,690,557 | A | | 11/1997 | Casillas et al. | |
| 5,725,438 | A | | 3/1998 | Dennesen | |
| 6,569,027 | B2 | | 5/2003 | Florian | |
| 6,626,767 | B2 | | 9/2003 | Lawlyes | |
| 6,638,174 | B1 | | 10/2003 | Ford | |
| 6,939,240 | B2 | | 9/2005 | Daley | |
| 7,258,621 | B2 | * | 8/2007 | McDuffee | 473/162 |
| 2002/0082100 | A1 | | 6/2002 | Moore | |
| 2003/0073506 | A1 | * | 4/2003 | Coplien | 473/157 |
| 2003/0096658 | A1 | * | 5/2003 | Elliott | 473/162 |
| 2004/0152529 | A1 | * | 8/2004 | Chen | 473/159 |
| 2005/0209014 | A1 | | 9/2005 | Kim | |

* cited by examiner

*Primary Examiner*—Mark S Graham
(74) *Attorney, Agent, or Firm*—Tipton L. Randall

(57) ABSTRACT

A portable golf putting practice kit includes a case member having a base portion with a hinged cover portion. The base portion includes one upstanding hinged wall that pivot outwardly and lies flat on a support surface. A cup and ball return insert member, contained within the base portion, includes a planar plateau section and a ramp section inclined from the base of the hinged wall to the planar plateau section. The plateau section includes at least two cup members extending below the plateau section. A ball return channel extends from the plateau section to the inclined surface at the base of the hinged, upstanding wall. A simulated turf matt member is secured to the plateau section and the ramp section and extends over the horizontal hinged wall onto the support surface beyond the case member. The rolled turf matt member is contained within the case member with the cover portion secure to the base portion in a closed condition.

17 Claims, 16 Drawing Sheets

PORTABLE GOLF PUTTING PRACTICE KIT

CROSS-REFERENCE TO RELATED APPLICATIONS, IF ANY

This application is a continuation of co-pending utility application Ser. No. 11/283,432, filed 19 Nov. 2005. Application Ser. No. 11/283,432 is hereby incorporated by reference. This application also claims the benefit under 35 U.S.C. §119 (e) of provisional application Ser. No. 60/690,233, filed 14 Jun. 2005. Application Ser. No. 60/690,233 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a golf putting practice kit and, more particularly, to a portable golf putting practice kit and, most particularly, to a portable golf putting practice kit containing all necessary equipment for such use.

2. Background Information

The state of the art includes various devices providing putting practice for golfers. This technology is believed to have significant limitations and shortcomings, including, but not limited to, that the devices do not provide a realistic surface that simulates actual putting practice on a real green. These putting practice devices are only marginally effective in allowing the player to obtain suitable experience in maintaining the player's putting skills.

For this and other reasons, a need exists for the present invention. This invention provides a portable golf putting practice kit, containing all necessary equipment for the player to practice putting skills, which is believed to fulfill the need and to constitute an improvement over the background technology.

Applicant has devised a portable golf putting practice kit that includes a putter, a cup, a simulated turf matt, and one or more golf balls, all contained in an easily transported, carrying case.

SUMMARY OF THE INVENTION

The invention is directed to a portable golf putting practice kit that includes a case member, having a base portion with upstanding walls and a planar bottom surface, and a cover portion hinged to the base portion. The cover portion has an exterior surface and an interior surface. The base portion includes one upstanding wall hinged at a wall base thereof, thereby allowing the hinged wall to pivot outwardly from the base portion and lie flat on a support surface. A cup and ball return insert member is contained within the base portion. The insert member includes a ramp section and a planar plateau section, with the ramp section having an inclined surface extending from the base of the hinged upstanding wall to the planar plateau section. The plateau section is elevated above the bottom surface of the base portion and includes at least two cup members, each with a top opening, a sidewall and a closed bottom end. The cup members extend below the plateau section and include a first cup member of a selected diameter and a second cup member of a diameter less than the selected diameter of the first cup member. The insert member also includes a ball return channel with a first section extending across the plateau section at an edge thereof opposite the ramp section of the insert member and from the plateau section to the inclined surface at the base of the hinged upstanding wall, and a second section intersecting the first and second cup members' sidewalls and connected to the first ball return section. The ball return channel is sized to accept a golf ball and inclined from the plateau section to the base of the hinged upstanding wall section. A simulated turf matt member is secured to the plateau section and the ramp section of the cup and ball return insert member. The turf matt member is adapted for extension over the hinged wall pivoted outwardly from the base portion and lying flat on a support surface, and onto the support surface beyond the case member. The turf matt member is sufficiently flexible that the rolled matt member is contained within the case member, with the hinged wall member in an upright orientation, and with the cover portion secured to the base portion in a closed condition.

In a preferred embodiment of the invention, the cover portion is removably hinged to the base portion and includes a plurality of recessed storage areas adapted for holding sections of a putter golf club and at least one golf ball. Additionally, the upstanding walls of the base portion extend above the ramp section and plateau section of the cup and ball return insert member, which is contained within the base portion. Most preferably, the upstanding hinged wall tapers from the hinged wall base to a top edge thereof. Further, a planar backstop member is pivotally secured to the base portion of the case member across the edge of the plateau section opposite the ramp section. The backstop member pivots from a horizontal orientation against the plateau section to a vertical orientation perpendicular to the plateau section. The simulated turf matt member further includes a first, contrasting, straight line on an upwardly oriented surface of the turf matt member in an extended condition. The first line extends from an end of the matt member opposite the cup and ball return insert through a center of the first cup member. Also included is second, contrasting, straight line on an upwardly oriented surface of the turf matt member in an extended condition. The second line extends from an end of the matt member opposite the cup and ball return insert through a center of the second cup member. The turf matt member extends beyond the base portion at least about nine times the length of the cup and ball return insert member.

DESCRIPTION OF THE EMBODIMENTS

Nomenclature

Figure 1:
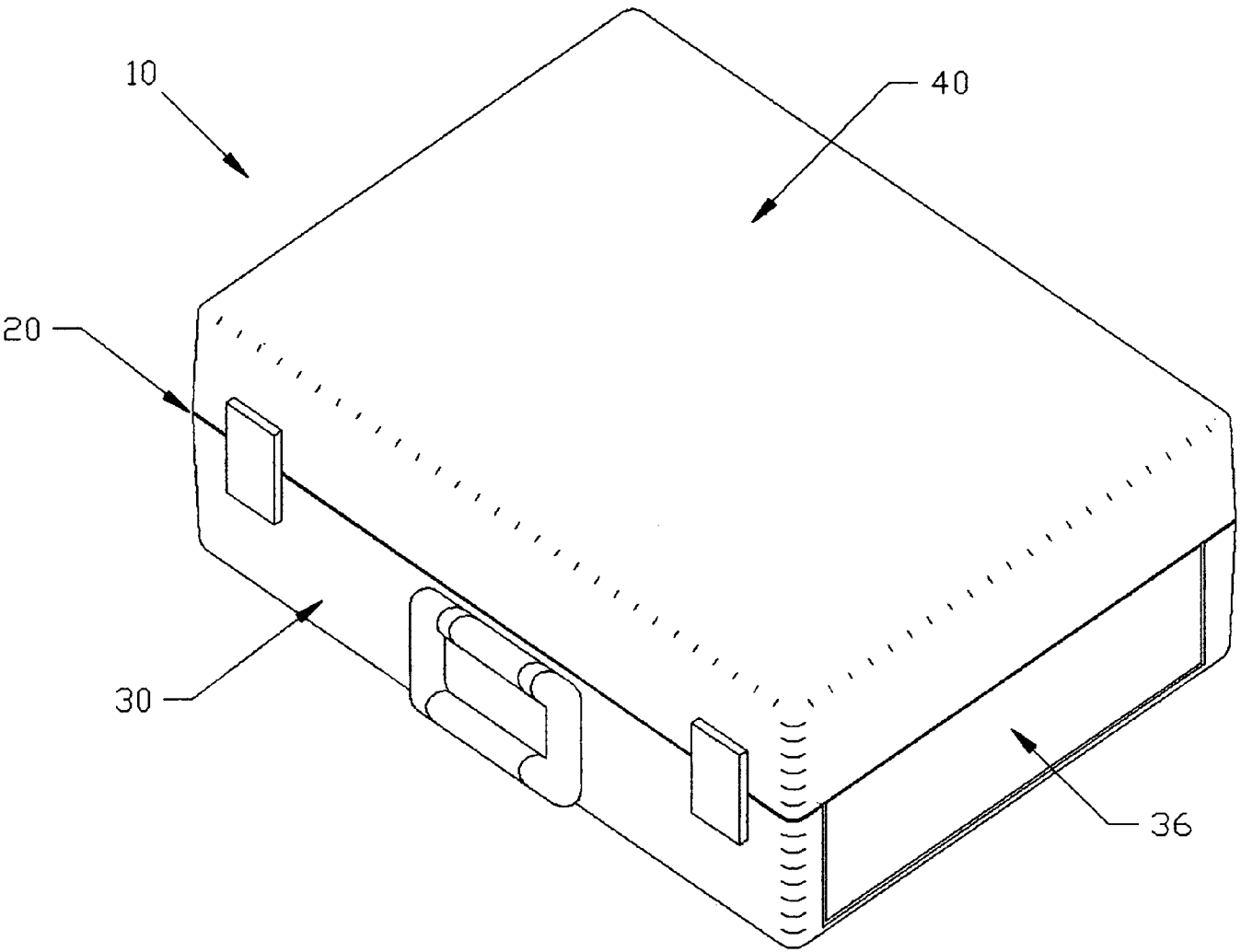
FIG. 1 is a perspective view of the golf putting practice kit of the present invention.
Figure 2:
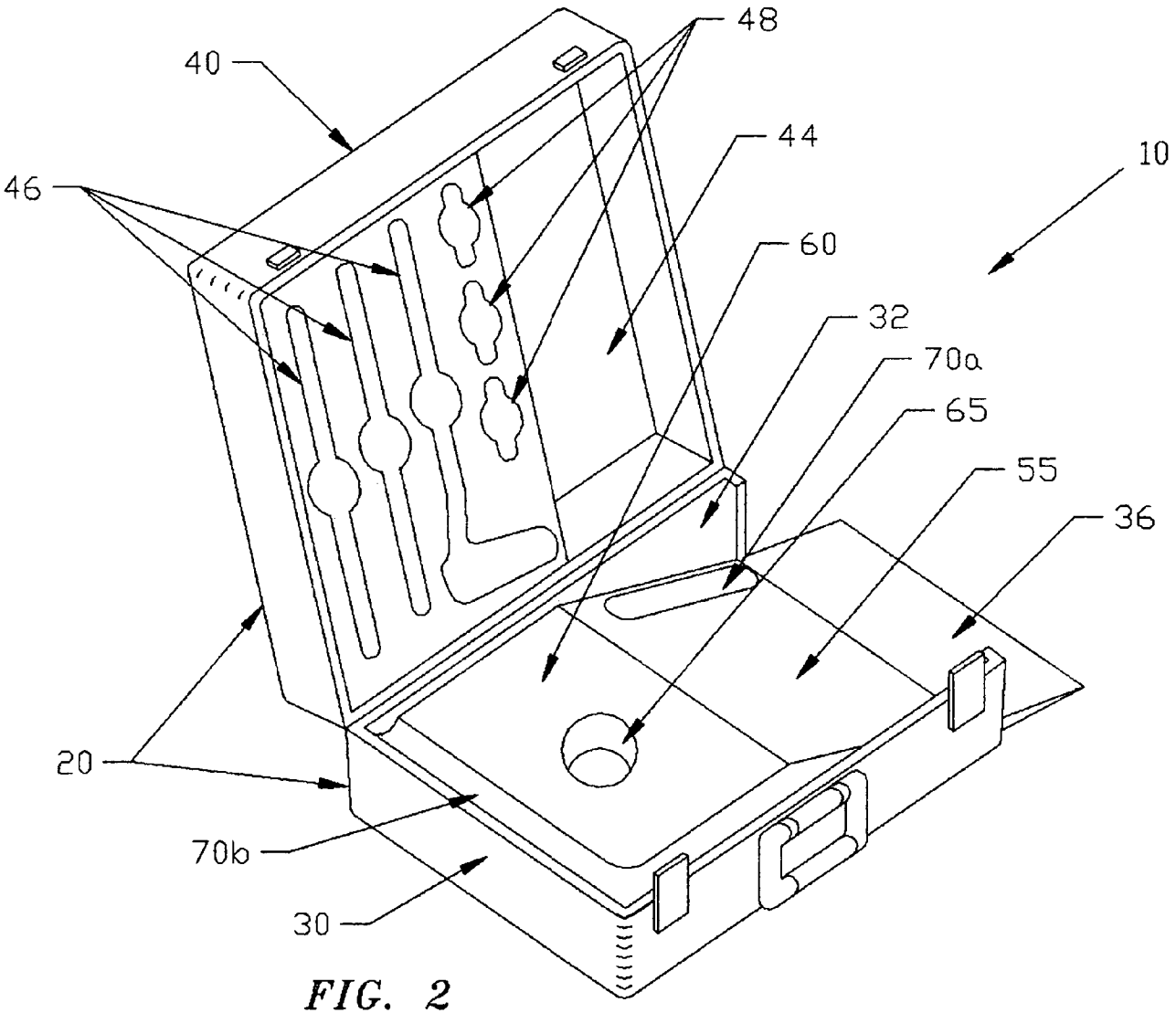
FIG. 2 is a perspective view of the golf putting practice kit of the present invention with the case member open.

10 Portable Golf Putting Practice Kit
20 Case Member
30 Base Portion of Case Member
32 Upstanding Walls of Base Portion
34 Planar Bottom Surface of Base Portion
36 Hinged Wall of Base Portion
37 Base of Hinged Wall
38 Top of Hinged Wall
40 Cover Portion of Case Member
42 Exterior Surface of Cover Portion
44 Interior Surface of Cover Portion
46 Recessed Storage Area of Cover Portion
48 Recessed Storage Area of Cover Portion
50 Cup and Ball Return Insert Member
55 Ramp Section of Insert Member
57 Inclined Surface of Ramp Section
60 Planar Plateau Section of Insert Member
62 Edge of Plateau Section Opposite the Ramp Section
65 Cup Member of Plateau Section
**65*a*** First Cup Member of Plateau Section
**65*b*** Second Cup Member of Plateau Section
66 Open Top of Cup Member
**66*a*** Open Top of First Cup Member
**66*b*** Open Top of Second Cup Member
67 Sidewall of Cup Member
**67*a*** Sidewall of First Cup Member
**67*b*** Sidewall of Second Cup Member
68 Closed Bottom of Cup Member
**68*a*** Closed Bottom of First Cup Member
**68*b*** Closed Bottom of Second Cup Member
70 Ball Return Channels
72 First Section of Ball Return Channel
74 Second Section of Ball Return Channel
80 Simulated Turf Matt Member
82 First Straight Line on Turf Matt Member
84 Second Straight Line on Turf Matt Member
90 Pivoting Planar Backstop Member
B Golf Ball
P Sections of Putter Golf Club
S Support Surface Construction The invention is a portable golf putting practice kit that includes a case member, having a base portion with upstanding walls and a planar bottom surface, and a cover portion hinged to the base portion. The cover portion has an exterior surface and an interior surface. The base portion includes one upstanding wall hinged at a wall base thereof, thereby allowing the hinged wall to pivot outwardly from the base portion and lie flat on a support surface. A cup and ball return insert member is contained within the base portion. The insert member includes a ramp section and a planar plateau section, with the ramp section having an inclined surface extending from the base of the hinged upstanding wall to the planar plateau section. The plateau section is elevated above the bottom surface of the base portion and includes at least two cup members, each with a top opening, a sidewall and a closed bottom end. The cup members extend below the plateau section and include a first cup member of a selected diameter and a second cup member of a diameter less than the selected diameter of the first cup member. The insert member also includes a ball return channel with a first section extending across the plateau section at an edge thereof opposite the ramp section of the insert member and from the plateau section to the inclined surface at the base of the hinged upstanding wall, and a second section intersecting the first and second cup members' sidewalls and connected to the first ball return section. The ball return channel is sized to accept a golf ball and inclined from the plateau section to the base of the hinged upstanding wall section. A simulated turf matt member is secured to the plateau section and the ramp section of the cup and ball return insert member. The turf matt member is adapted for extension over the hinged wall pivoted outwardly from the base portion and lying flat on a support surface, and onto the support surface beyond the case member. The turf matt member is sufficiently flexible that the rolled matt member is contained within the case member, with the hinged wall member in an upright orientation, and with the cover portion secured to the base portion in a closed condition.

In a preferred embodiment of the invention, the cover portion is removably hinged to the base portion and includes a plurality of recessed storage areas adapted for holding sections of a putter golf club and at least one golf ball. Additionally, the upstanding walls of the base portion extend above the ramp section and plateau section of the cup and ball return insert member, which is contained within the base portion. Most preferably, the upstanding hinged wall tapers from the hinged wall base to a top edge thereof. Further, a planar backstop member is pivotally secured to the base portion of the case member across the edge of the plateau section opposite the ramp section. The backstop member pivots from a horizontal orientation against the plateau section to a vertical orientation perpendicular to the plateau section. The simulated turf matt member further includes a first, contrasting, straight line on an upwardly oriented surface of the turf matt member in an extended condition. The first line extends from an end of the matt member opposite the cup and ball return insert through a center of the first cup member. Also included is second contrasting straight line on an upwardly oriented surface of the turf matt member in an extended condition. The second line extends from an end of the matt member opposite the cup and ball return insert through a center of the second cup member. The turf matt member extends beyond the base portion at least about nine times the length of the cup and ball return insert member.

Figure 3:
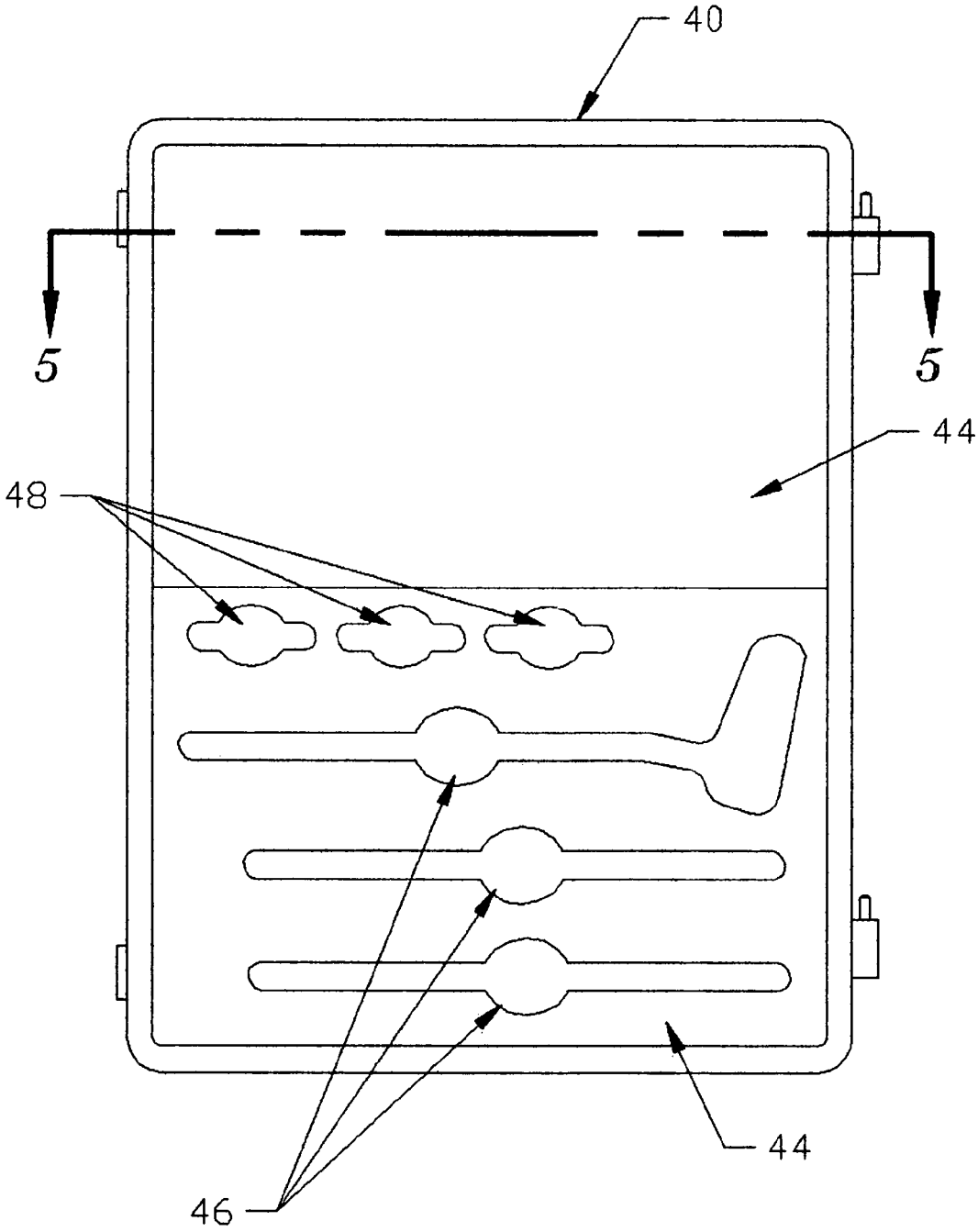
FIG. 3 is a plan view of the interior surface of the cover portion of the case member of the golf putting practice kit of the present invention.
Figure 4:
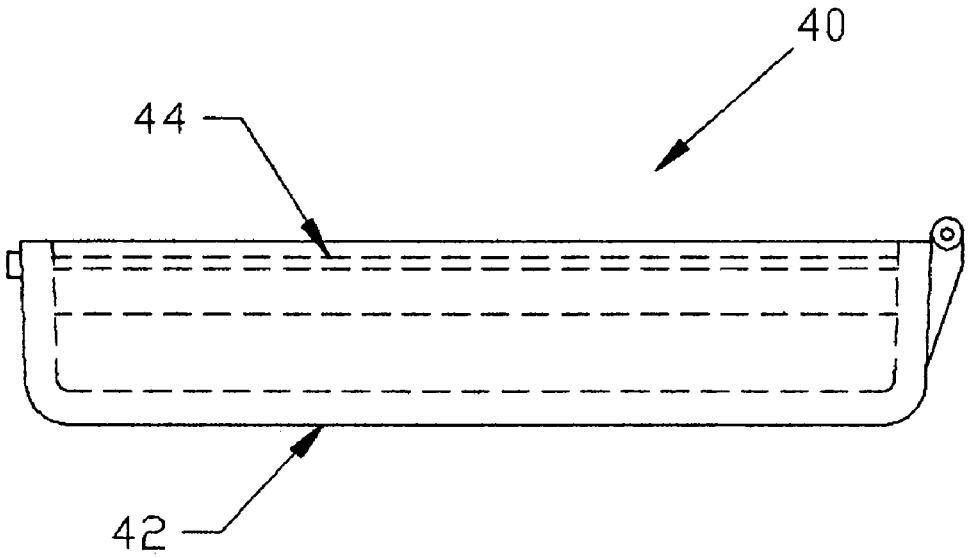
FIG. 4 is a side view of the cover portion of the case member of the golf putting practice kit of the present invention.
Figure 5:
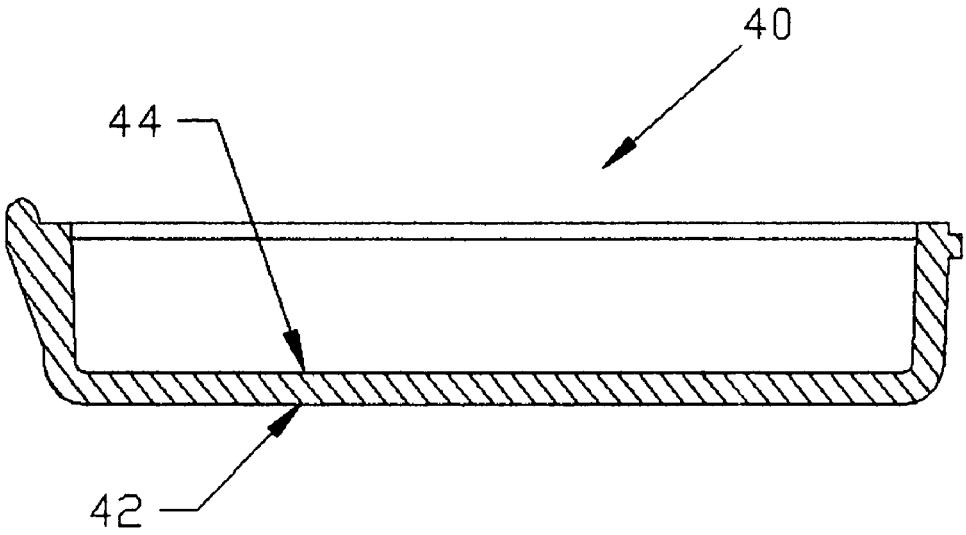
FIG. 5 is a sectional view along line 5-5' of FIG. 3 of the cover portion of the case member of the golf putting practice kit of the present invention.
Figure 6:
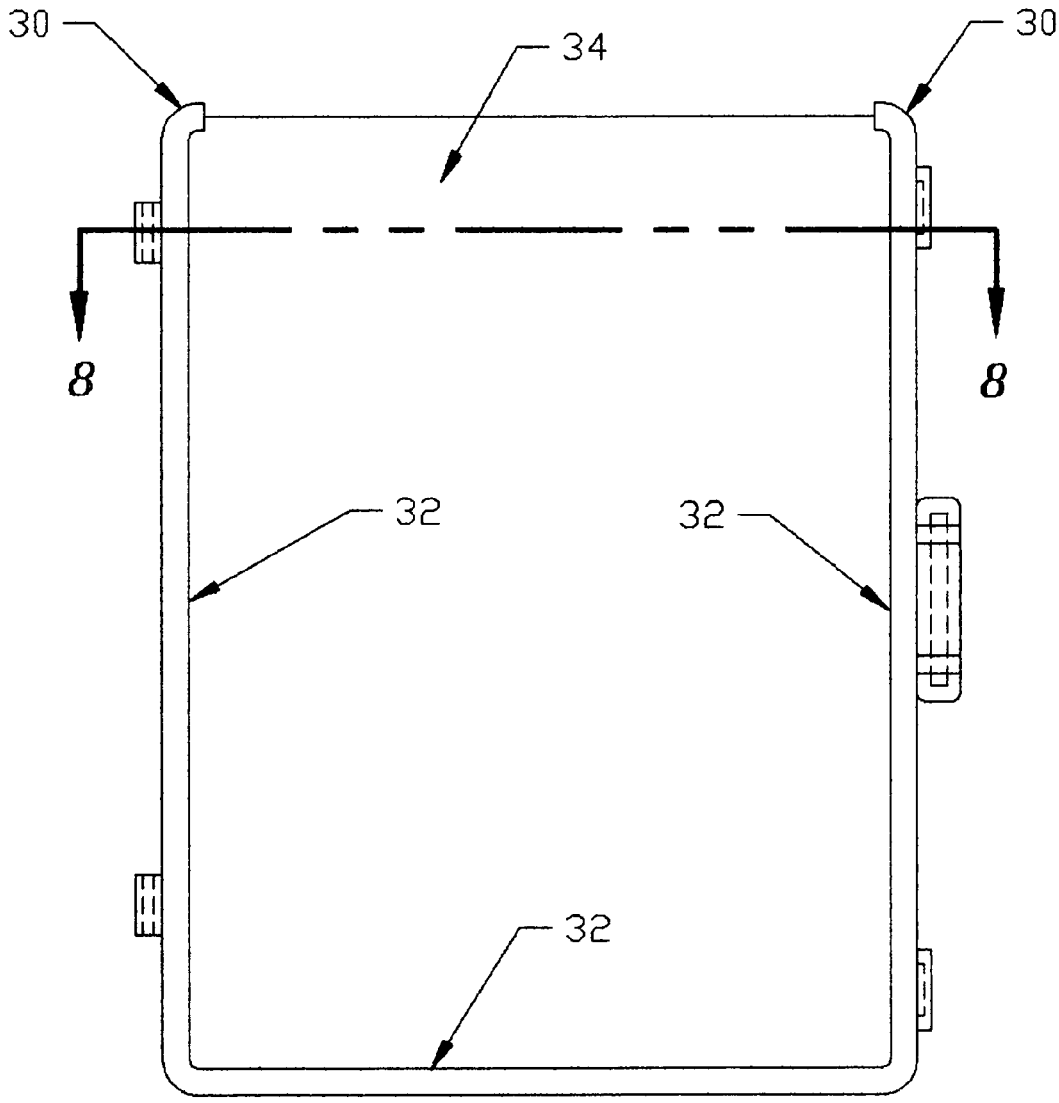
FIG. 6 is a plan view of the interior surface of the base portion of the case member of the golf putting practice kit of the present invention.

Referring now to FIGS. 1-6, one embodiment of the portable golf putting practice kit 10 is illustrated. The practice kit 10 includes a case member 20 having a base portion 30 with upstanding walls 32 and a planar bottom surface 34. The cover portion 40 is hinged to the base portion 30, with the cover portion 40 having an exterior surface 42 and an interior surface 44. The practice kit 10 is shown in the closed condition in FIG. 1 and an open condition in FIG. 2. The cover portion 40 is shown in FIGS. 3-5, and a top view of the bottom portion 30 is seen in FIG. 6.

Figure 7:
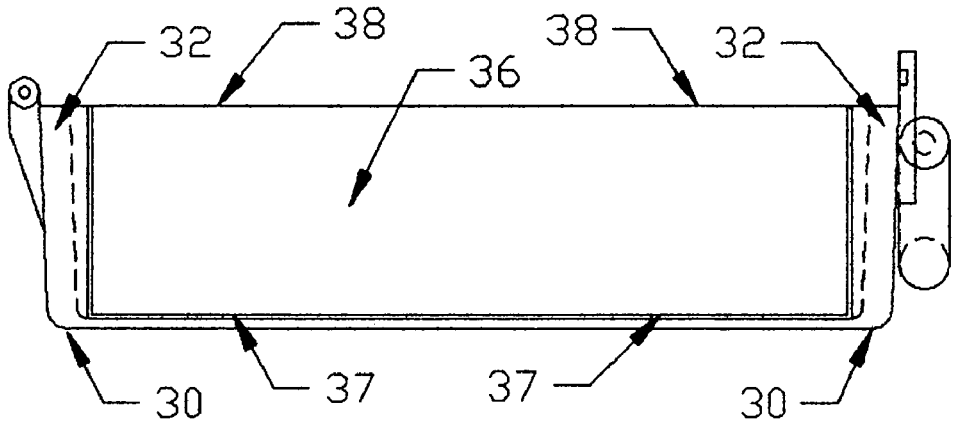
FIG. 7 is a side view of the base portion of the case member of the golf putting practice kit of the present invention.
Figure 8:
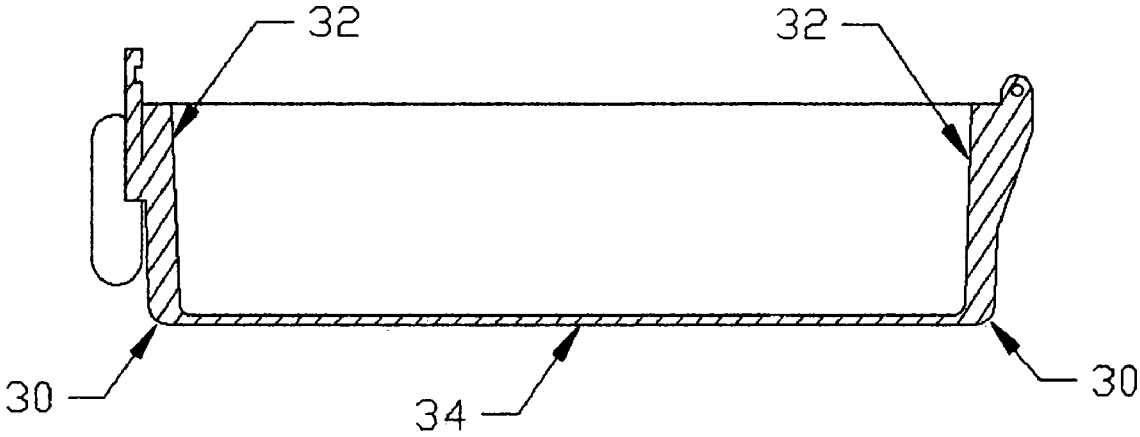
FIG. 8 is a sectional view along line 8-8' of FIG. 6 of the base portion of the case member of the golf putting practice kit of the present invention.
Figure 9:
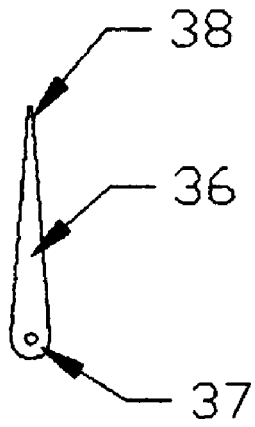
FIG. 9 is a sectional view of the hinged sidewall of the base portion of the case member of the golf putting practice kit of the present invention.
Figure 10:
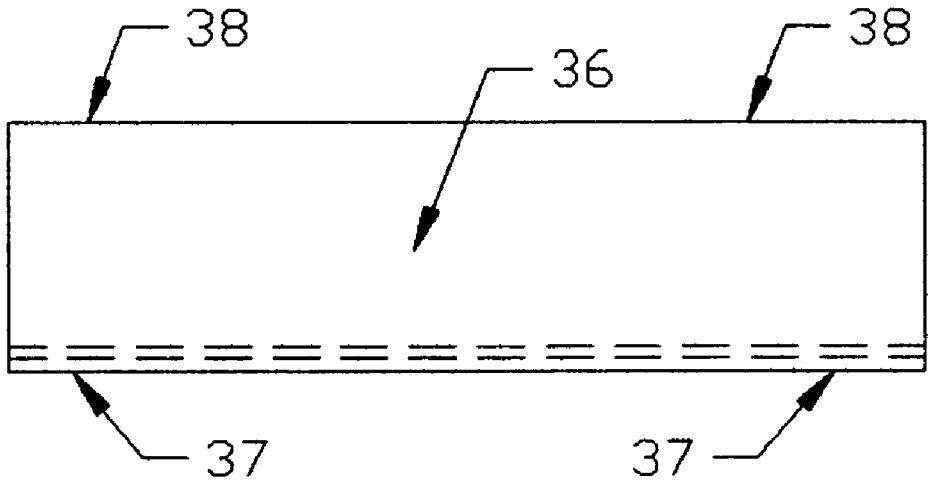
FIG. 10 is a plan side view of the hinged sidewall of the base portion of the case member of the golf putting practice kit of the present invention.

Referring to FIGS. 6-10, the base portion 30 includes one upstanding wall 36 hinged at a wall base 37 thereof, thereby allowing the hinged wall 36 to pivot outwardly from the base portion 30 and lie flat on a support surface S. The hinged wall 36 is illustrated in FIGS. 7, 9 and 10.

Figure 11:
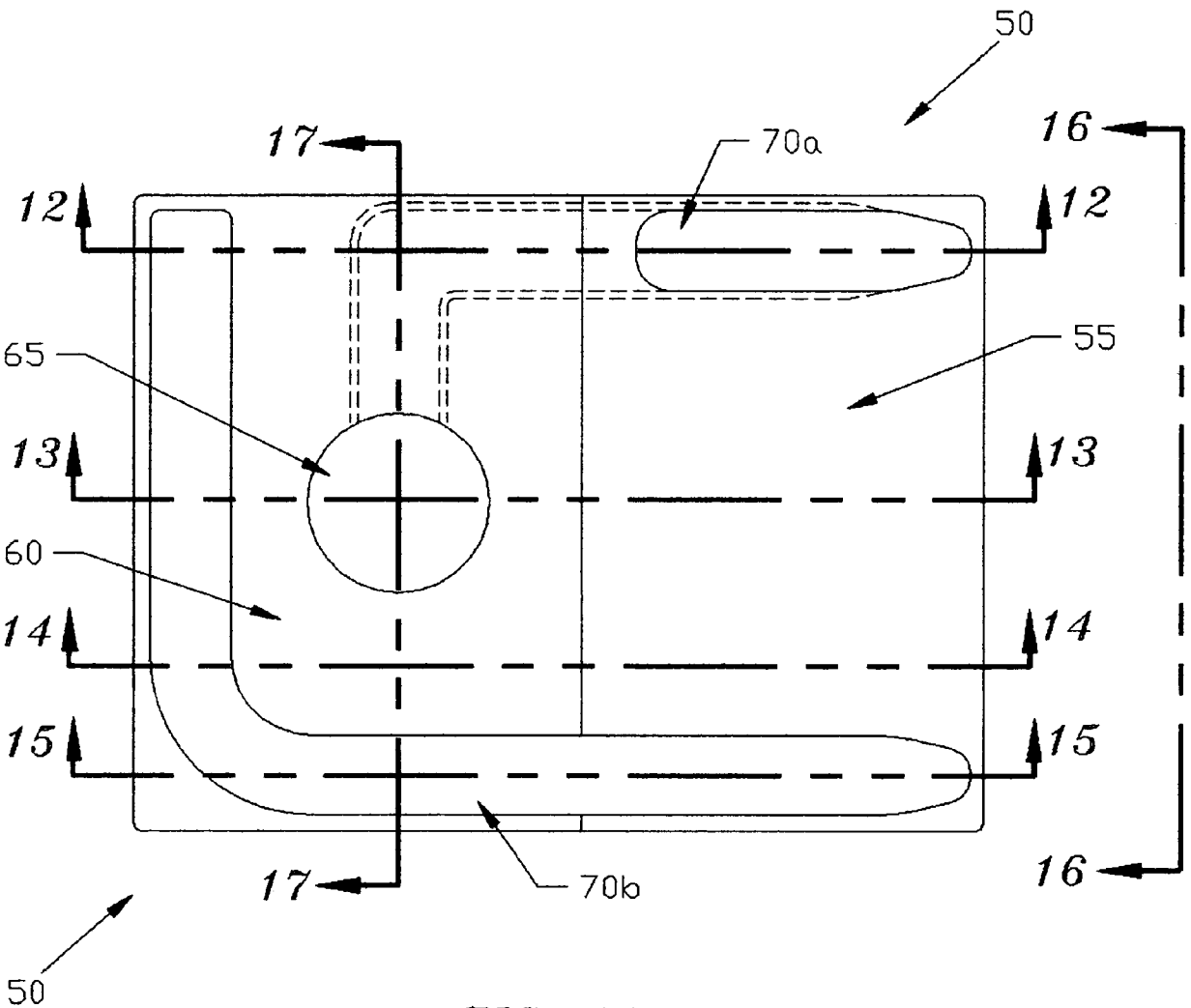
FIG. 11 is a top plan view of the cup and ball return insert member of the base portion of the case member of the golf putting practice kit of the present invention.
Figure 12:
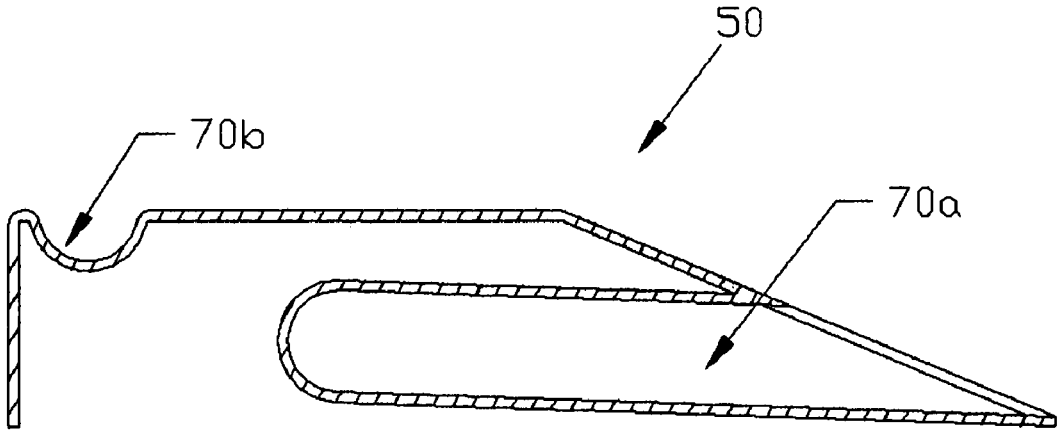
FIG. 12 is a sectional view along line 12-12' of FIG. 11 of the cup and ball return insert member of the golf putting practice kit of the present invention.
Figure 13:
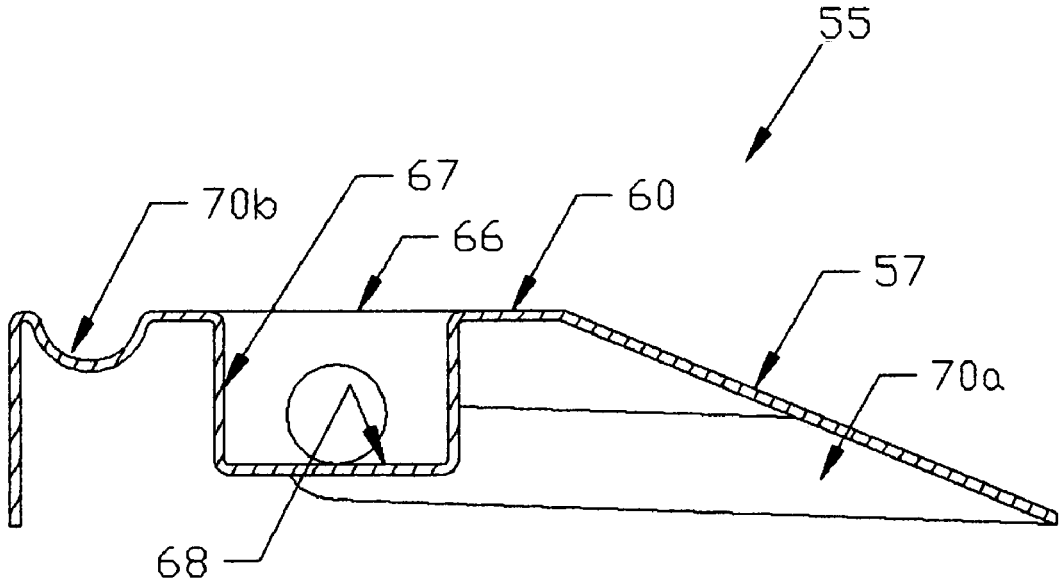
FIG. 13 is a sectional view along line 13-13' of FIG. 11 of the cup and ball return insert member of the golf putting practice kit of the present invention.
Figure 14:
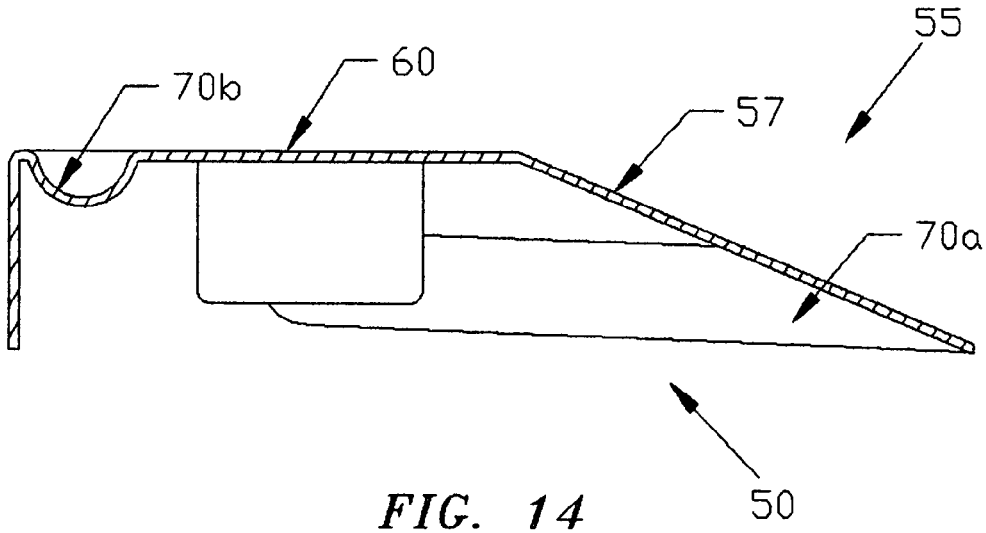
FIG. 14 is a sectional view along line 14-14' of FIG. 11 of the cup and ball return insert member of the golf putting practice kit of the present invention.
Figure 15:
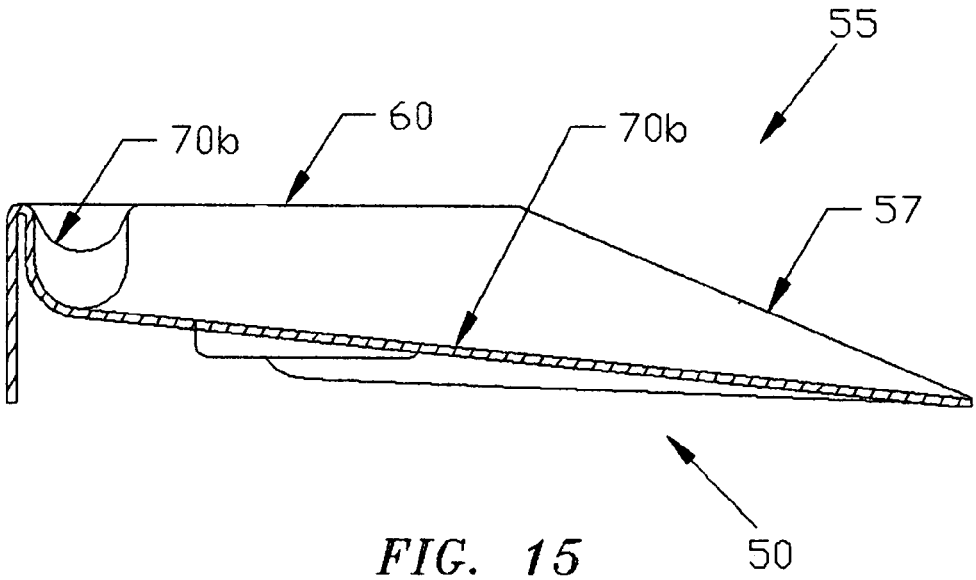
FIG. 15 is a sectional view along line 15-15' of FIG. 11 of the cup and ball return insert member of the golf putting practice kit of the present invention.
Figure 16:
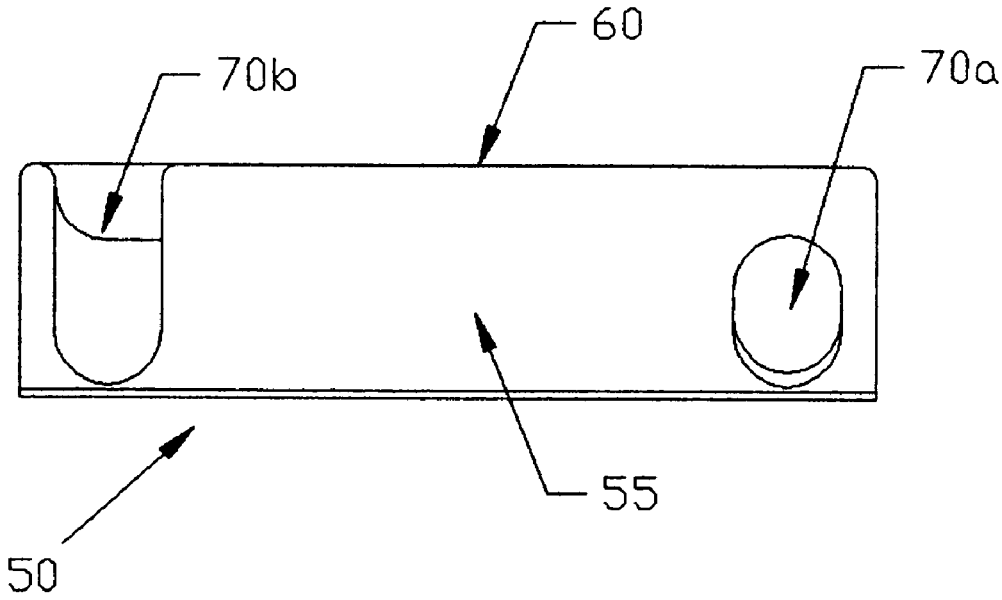
FIG. 16 is a sectional view from line 16-16' of FIG. 11 of the cup and ball return insert member of the golf putting practice kit of the present invention.
Figure 17:
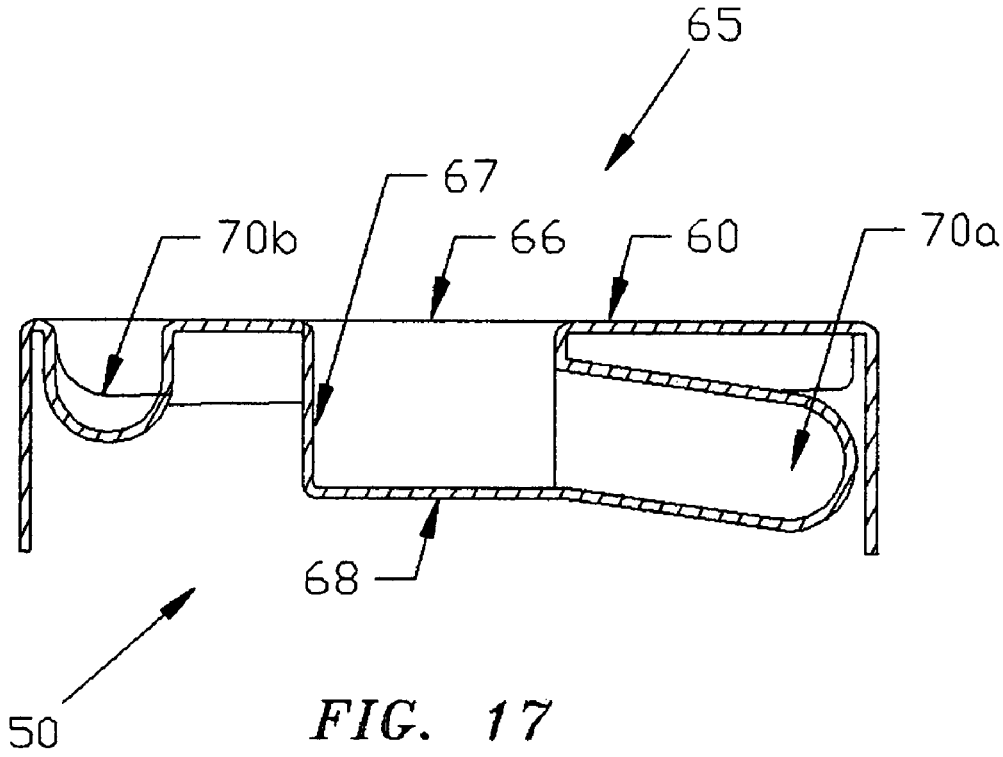
FIG. 17 is a sectional view along line 17-17' of FIG. 11 of the cup and ball return insert member of the golf putting practice kit of the present invention.

Referring now to FIGS. 11-17, a cup and ball return insert member 50 is contained within the base portion 30. The insert member 50 includes a ramp section 55 and a planar plateau section 60, with the ramp section 50 having an inclined surface 57 extending from the base 37 of the hinged upstanding wall 36 to the planar plateau section 60. The ramp section 55 and the plateau section 60 are best seen in FIGS. 13 and 14. The plateau section 60 is elevated above the bottom surface 34 of the base portion 30 and includes a cup member 65 having a top opening 66, a sidewall 67 and a closed bottom end 68. The cup member 65 extends below the plateau section 60, as illustrated in FIGS. 13, 14 and 17. The insert member 50 also includes ball return channels 70, extending from the plateau section 60 to the inclined surface 57 of the ramp section 55 at the base 37 of the hinged upstanding wall 36. The ball return channels 70 are sized to accept a golf ball and inclined from the plateau section 60 toward the base 37 of the hinged upstanding wall 36. The ball return channels 70 are best seen in FIGS. 11, 15 and 17.

Figure 18:
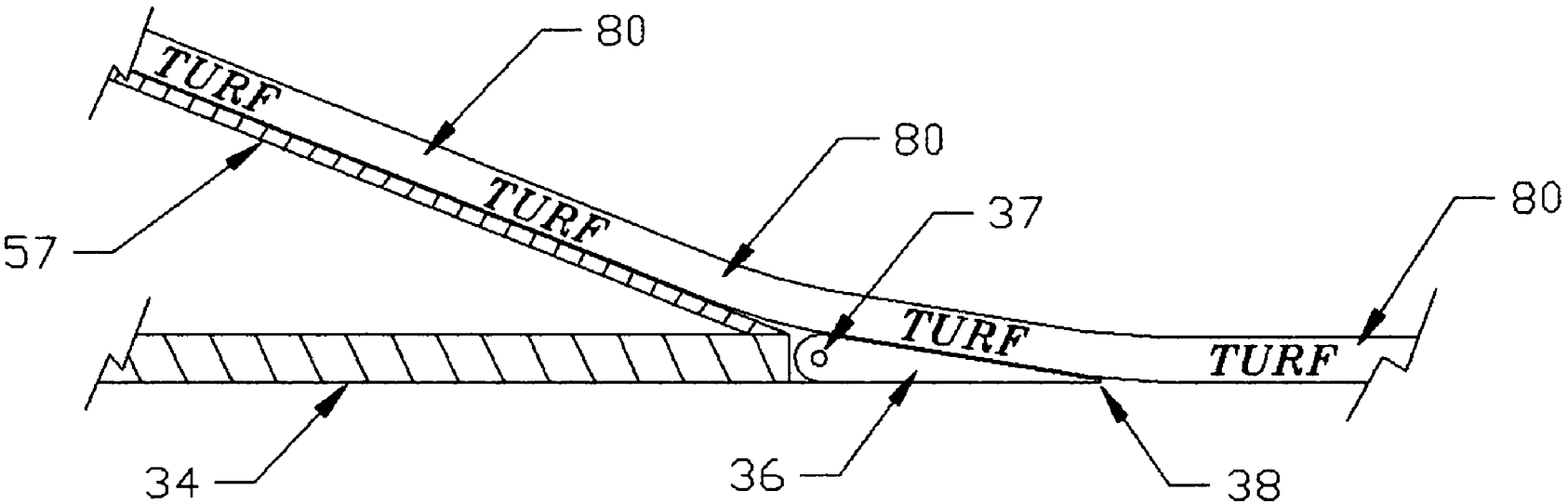
FIG. 18 is a sectional view of the simulated turf matt member deployed over the hinged wall of the base portion of the golf putting practice kit of the present invention.
Figure 19:
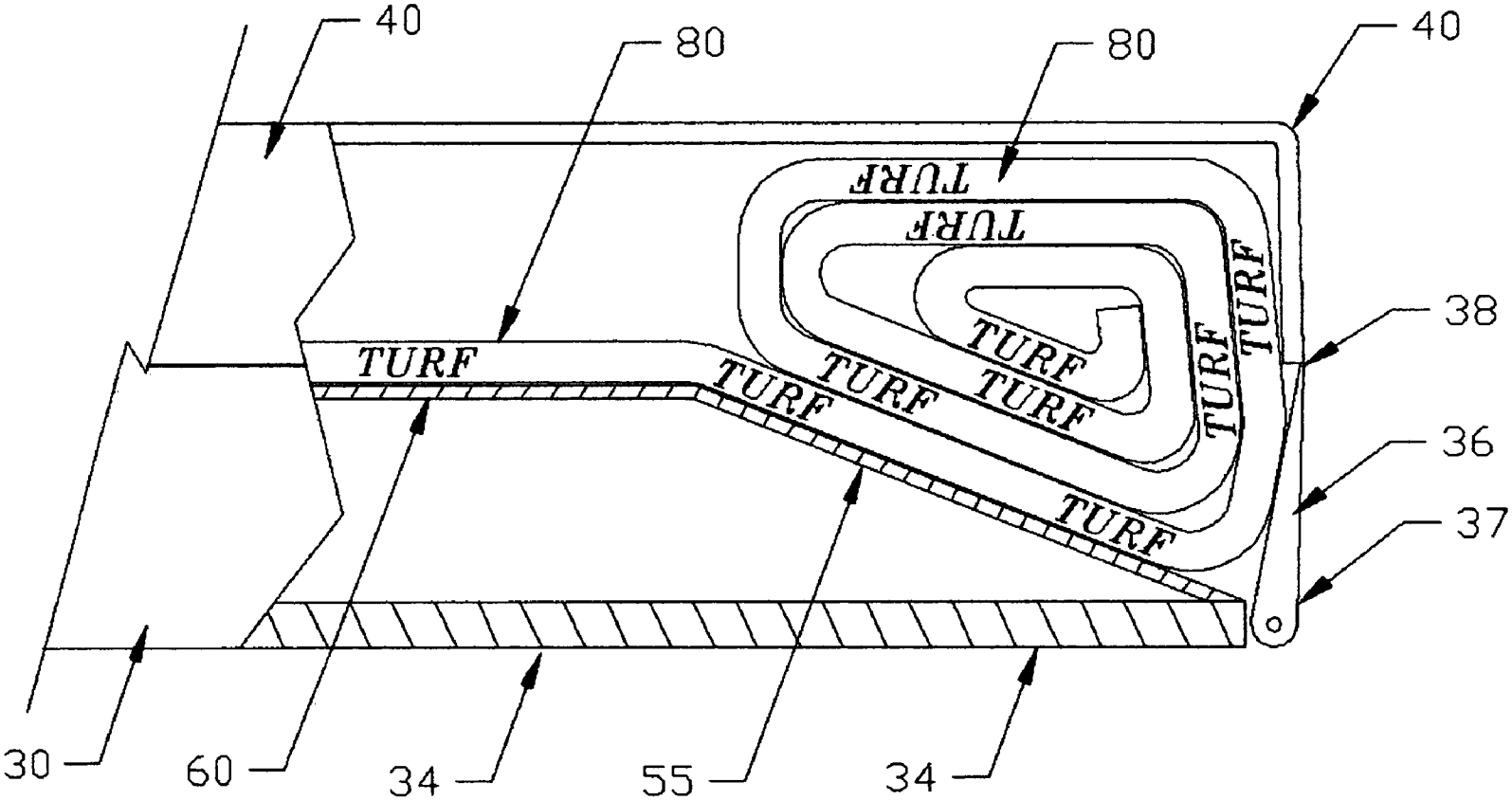
FIG. 19 is a sectional view of the simulated turf matt member rolled for storage within the case member of the golf putting practice kit of the present invention.

A simulated turf matt member 80 is secured at one end to the plateau section 60 and the ramp section 55 of the cup and ball return insert member 50, but leaves the cup top 66 open as well as the ball return channels 70. The turf matt member 80 has a width equal to the width of the insert member 50 and a total length about ten times the length of the insert member 50. The turf matt member 80 is adapted for extension over the hinged wall 36, with the wall 36 pivoted outwardly from the base portion 30 and lying flat on a support surface S. The turf matt member 80 extends onto the support surface S beyond the case member 10, as illustrated in FIG. 18. The turf matt member 80 is composed of a relatively thin latex layer bonded to a synthetic turf layer. The turf matt member 80 is sufficiently flexible that the portion of the rolled matt member 80 not secured to the insert member 50 is contained within the case member 10, with the hinged wall member 36 in an upright orientation, and the cover portion 40 secured to the base portion 30 in a closed condition, as illustrated in FIG. 19.

In a preferred embodiment of the invention, the cover portion 40 is removably hinged to the base portion 30 and includes a plurality of recessed storage areas 46, 48 adapted for holding sections of a putter golf club P and at least one golf ball B, as illustrated in FIG. 3. Preferably the recessed storage areas 46, 48 are limited to one end of the cover portion 40 and occupy about one half of the internal area of the cover portion 40. The unoccupied internal area of the cover portion 40 provides space for storage of the rolled up turf matt member 80, as illustrated in FIG. 19.

Additionally, the upstanding walls 30 of the base portion 30 extend above the ramp section 55 and plateau section 60 of the cup and ball return insert member 50 contained within the base portion 30. The upstanding walls 30 of the base portion 30 prevent a golf ball B from traveling beyond the plateau section 60 when propelled up the ramp section 55 by the golfer.

Most preferably, the upstanding hinged wall 36 tapers from the hinged base 37 to the top edge 38, as illustrated in FIG. 9, with the hinge positioned such that the hinged wall 36 aligns with the inclined surface 57 of the ramp portion 55 of the insert member 50. As shown in FIG. 18, the taper of the hinged wall 36 provides for a smooth transition of the turf matt member 80 from the inclined surface 57 of the ramp section 55, over the hinged wall 36, and to the support surface S exterior the base portion 30 of the case member 20. Further, one ball return channel 70*a* intersects the cup member 65 of the plateau section 60, and another ball channel 70*b* extends across the plateau section 60 adjacent a plateau section's edge 62 opposite the ramp section 55. Thus, all golf balls B propelled up the ramp section 55 are returned toward the player, regardless of falling into the cup member 65 or not. The upward angle of the ramp section 55 requires the player to propel the golf ball B at a minimum velocity toward the cup member 65 to traverse the ramp section 55. This teaches the player to putt the golf ball B with sufficient velocity to maintain a good line to the cup member 65.

In a further embodiment of the invention, an elevation device is attached to the underside of the insert member 30 beneath the plateau section 60. The elevation device elevates the end of the insert member 30 opposite the ramp section 55. This pivoting of the insert member 30 imparts a steeper angle to the ramp section 55, requiring the putted ball to have increased speed in order to ascend the ramp section 55 toward the cup member 65. Such a configuration of the insert member 30 simulates longer distances when putting the golf ball B.

The simulated turf matt member 80 extends beyond the base portion 30 at least about nine times the length of the cup and ball return insert member 50, thereby providing sufficient distance between the cup member 65 and the player to achieve useful putting practice results. Additionally, the free end of the simulated turf matt member 80 includes a weighted fastening mechanism to assist in holding the simulated turf matt member 80 in a level condition when it is rolled out of the storage area within the case member 20. The weighted fastening mechanism preferably includes a length of hook and loop tape attached thereto, to assist in securing the simulated turf matt member 80 to a carpeted surface and provide a level putting surface for the golfer to practice upon.

In a further embodiment of the invention, a number of relatively thin sponge pads or wedges are contained within the case member 20. The sponge pads or wedges are inserted beneath the rolled out turf matt member 80 to provide areas of elevation to the extended matt member 80, thereby imparting a degree of "break" as the golf ball B passes over the area of elevation of the turf matt member 80.

The portable golf putting practice kit 10 of the present invention provides all materials necessary for the golfer to practice putting whenever desired. The practice kit 10 includes a durable case member 20 with suitable carrying handle and latches or locks. The player opens the case member 20 and detaches the hinged cover portion 40 from the base portion 30. The cover portion 40 houses sections of a putting club P that are easily assembled into a standard golf putter. Optionally, the kit 10 includes several interchangeable club heads, such as a pitching wedge head and/or a sand wedge head, in addition to the putter club head. The additional club heads, also contained in the cover portion 40, provide added versatility to the golf practice kit 10. Several golf balls B are also housed in the cover portion 40, and one or more is removed for putting practice. With the base portion 30 on a horizontal surface, the player pivots the hinged wall 36 from vertical to horizontal and unrolls the synthetic turf matt member 80 to its full length. The player can then putt a ball B on the matt member 80 toward the base portion 30 containing the insert member 50 with the assembled putter P. The putted ball B rolls over the matt member 80 and up the inclined surface 57 of the ramp section 55 to the plateau area 60. If the ball B goes into the cup member 65, the ball B rolls to the ball return channel 70*a* and eventually back to the player. If the ball B does not go into the cup member 65, the ball B enters the other ball return channel 70*b* and is also returned back toward the player. The components of the practice kit 10 are readied for storage and/or transport by simply reversing the order of the assembly steps.

Figure 20:
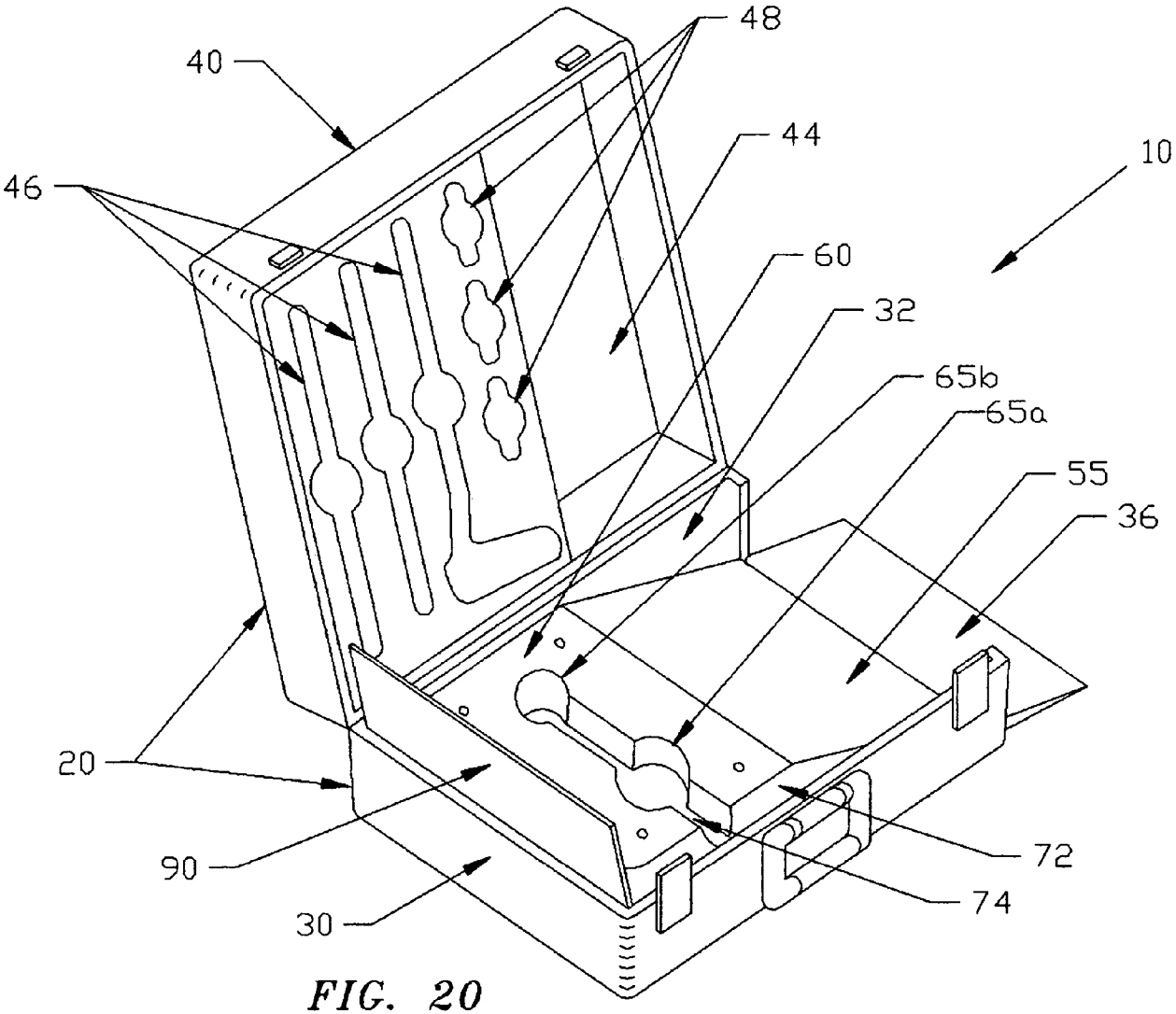
FIG. 20 is perspective view of another embodiment of the golf putting practice kit of the present invention with the case member open.
Figure 21:
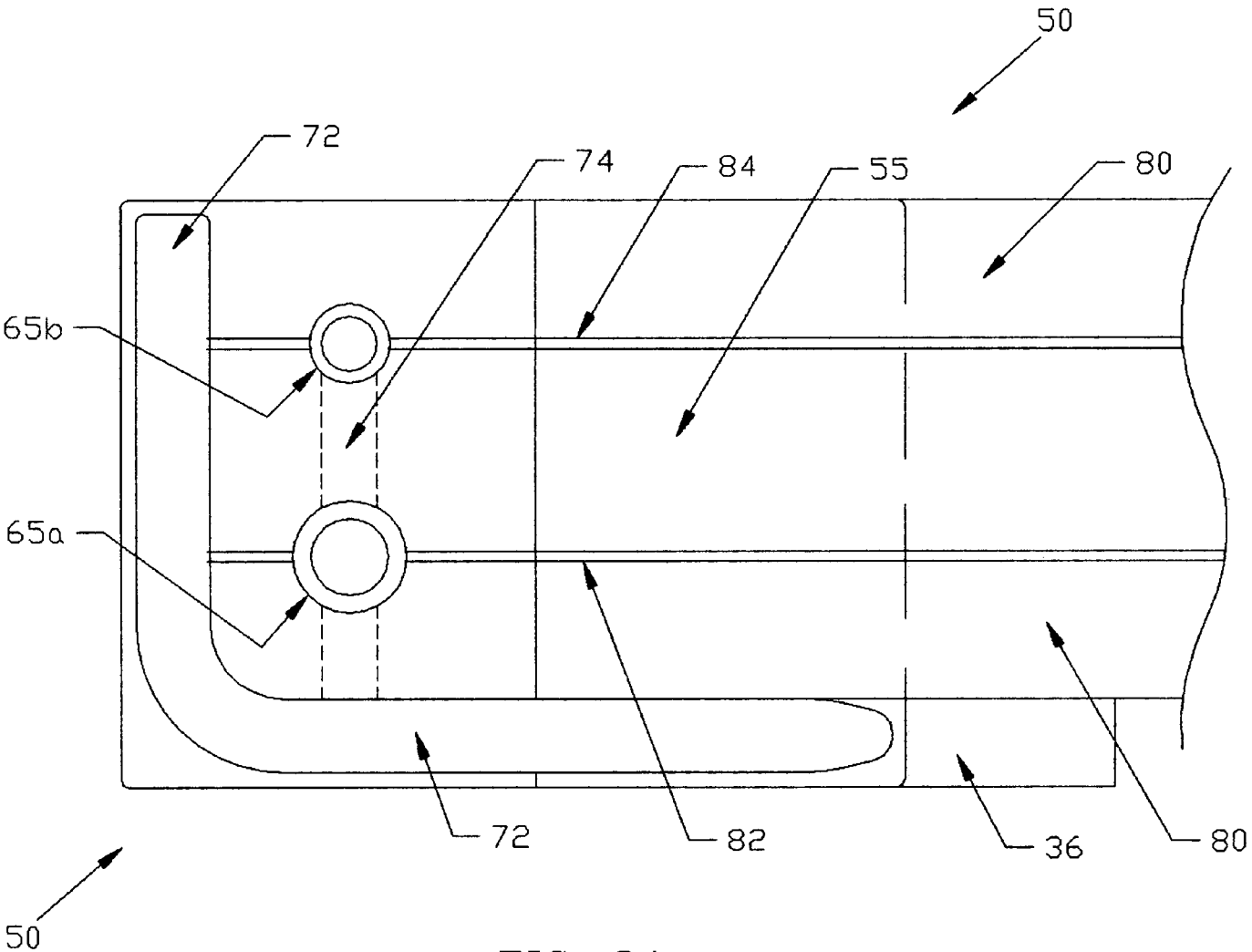
FIG. 21 is a top plan view of the cup and ball return insert member of the base portion of the case member of FIG. 20 of the golf putting practice kit of the present invention.
Figure 22:
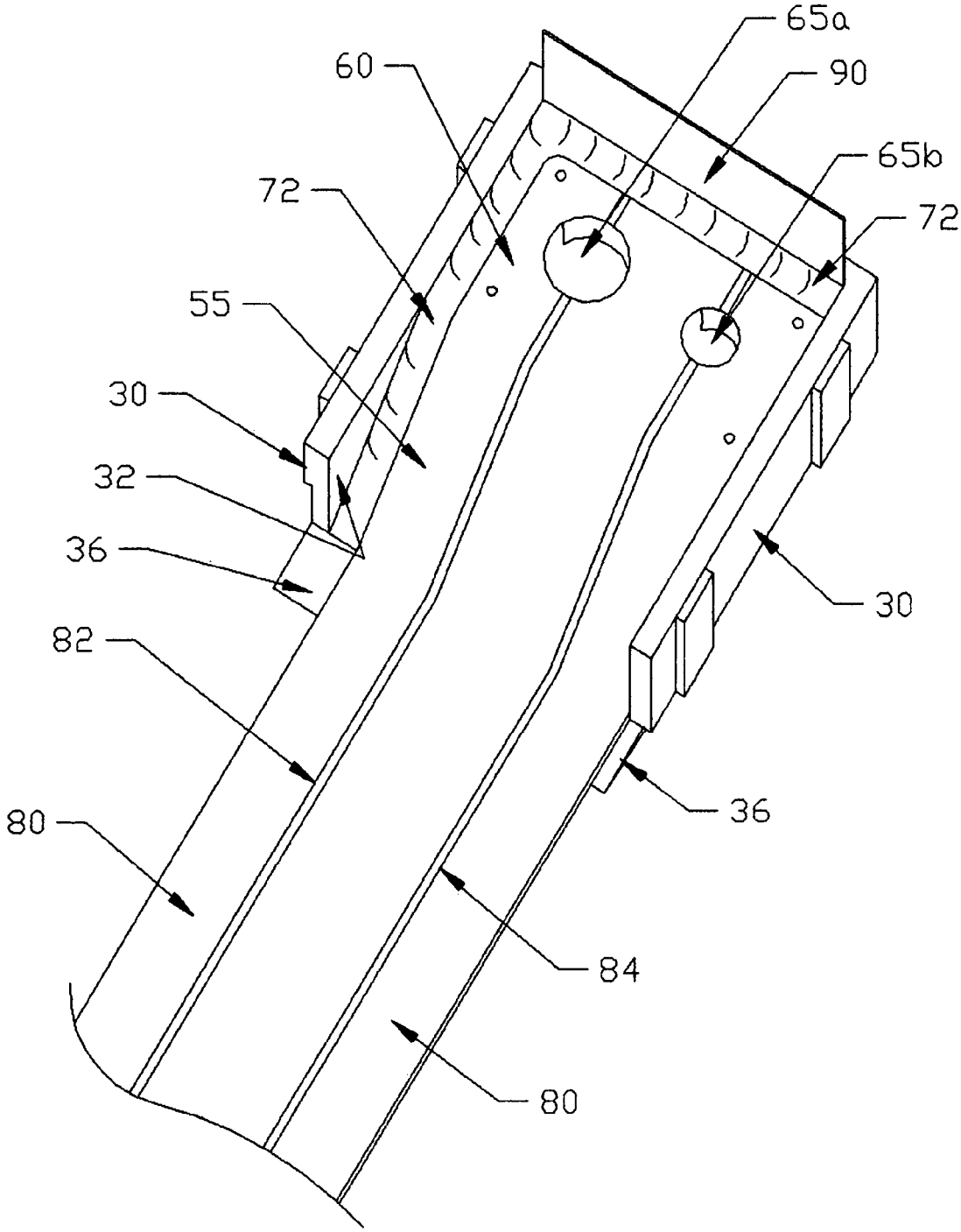
FIG. 22 is a perspective view of the cup and ball return insert member and the base portion of the case member of the present invention with the turf matt member unrolled over the hinged sidewall and onto a support surface.

Referring now to FIGS. 20-22, an alternative embodiment of the practice kit 10 is illustrated. The practice kit 10 includes a case member 20 having a base portion 30 with upstanding walls 32 and a planar bottom surface 34. The cover portion 40 is hinged to the base portion 30, with the cover portion 40 having an exterior surface 42 and an interior surface 44. The practice kit 10 is shown in the closed condition in FIG. 1 and an open condition in FIG. 20. The cover portion 40 is shown in FIGS. 3-5, and a top view of the bottom portion 30 is seen in FIG. 6.

Referring to FIGS. 6-10, the base portion 30 includes one upstanding wall 36 hinged at a wall base 37 thereof, thereby allowing the hinged wall 36 to pivot outwardly from the base portion 30 and lie flat on a support surface S. The hinged wall 36 is illustrated in FIGS. 7, 9 and 10.

Referring again to FIGS. 20-22, an alternative embodiment of the cup and ball return insert member 50 is contained within the base portion 30. The insert member 50 includes a ramp section 55 and a planar plateau section 60, with the ramp section 55 having an inclined surface 57 extending from the base 37 of the hinged upstanding wall 36 to the planar plateau section 60. The ramp section 55 and the plateau section 60 are the same as seen in FIGS. 13 and 14. The plateau section 60 is elevated above the bottom surface 34 of the base portion 30 and includes at least two cup members 65*a*, 65*b*, each with a top opening 66*a*, 66*b*, a sidewall 67*a*, 67*b* and a closed bottom end 68*a*, 68*b*. The cup members 65 extend below the plateau section 60 and include a first cup member 65*a* of a selected diameter and a second cup member 65*b* of a diameter less than the selected diameter of the first cup member 65*a*. Preferably, the first cup member 65*a* has a diameter of 4.25 inches and the second cup member 65*b* has a diameter of 2.0 inches.

In a preferred embodiment, the at least two cup members 65*a*, 65*b* are positioned equidistant from the wall base 37 of the upstanding hinged wall 36, thereby positioning the two cup members 65*a*, 65*b* on a line.

The insert member 50 also includes a ball return channel 70, extending from the plateau section 60 to the inclined surface 57 of the ramp section 55 at the base 37 of the hinged upstanding wall 36. The ball return channel 70 is sized to accept a golf ball and inclined from the plateau section 60 toward the base 37 of the hinged upstanding wall 36. In the embodiment of FIGS. 20-22, the ball channel 70 includes a first section 72 extending across the plateau section 60 at an edge thereof opposite the ramp section 55 of the insert member 50 and from the plateau section 60 to the inclined surface 57 at the base of the hinged upstanding wall 36. A second section 74 intersects the first and second cup members' sidewalls 67*a*, 67*b* and is connected to the first ball return section 72. In the embodiment of FIGS. 20-22, the ball return channel's second section 74 routes the golf ball from the second cup member 65*b* to the first cup member 65*a* and to the first section 72 of the ball return channel 70. Additionally, the first section 72 of the ball return channel 70 is open to the insert member's ramp section 55 and plateau section 60 to accept any golf balls failing to enter one of the cup members 65*a*, 65*b*. The second section 74 of the ball return channel 70, connecting the cup members 65*a*, 65*b* and the first section 72, is covered by the turf matt member 80, as illustrated in FIG. 21. The second section 74 is inclined from the second cup member 65*b* toward the first cup member 65*a* and inclined toward the first section 72 to deliver all golf balls putted into either cup member 65*a*, 65*b* to the first section 72 of the ball return channel 70.

In a further embodiment of the invention, the practice kit 10 includes a planar backstop member 90 pivotally secured to the base portion 30 of the case member 20, with the backstop member 90 extending across the edge of the plateau section 60 opposite the ramp section 55. The backstop member 90 is located along one edge of the ball return channel 70 and extends across the plateau section 60 opposite the cup members 65*a*, 65*b*. The backstop member 90 pivots from a horizontal orientation against the plateau section 60, as illustrated in FIG. 20, to a vertical orientation, perpendicular to the plateau section 60, as illustrated in FIG. 22. The backstop member 90 prevents putted golf balls B from overshooting the ball return channel 70. Preferably, the backstop member 90 includes a peg on each end, which fits into an aperture in the base portion 30. The backstop member 90 is sufficiently flexible that it can be removed from the base portion 30 by disengaging the pegs from the apertures in the base portion 30, if desired, by the golfer.

A simulated turf matt member 80 is secured at one end to the plateau section 60 and the ramp section 55 of the cup and ball return insert member 50, but leaves the at least two cup tops 66*a*, 66*b* open, as well as the first section 72 of the ball return channel 70. The turf matt member 80 has a width equal to the width of the insert member 50, excluding first section 72 of the ball return channel 70, and a total length about ten times the length of the insert member 50. The turf matt member 80 is adapted for extension over the hinged wall 36, with the wall 36 pivoted outwardly from the base portion 30 and lying flat on a support surface S. The turf matt member 80 extends onto the support surface S beyond the case member 10, as illustrated in FIGS. 18 and 22. The turf matt member 80 is composed of a relatively thin latex layer bonded to a synthetic turf layer. The turf matt member 80 is sufficiently flexible that the portion of the rolled matt member 80 not secured to the insert member 50 is contained within the case member 10, with the hinged wall member 36 in an upright orientation, and the cover portion 40 secured to the base portion 30 in a closed condition, as illustrated in FIG. 19. Preferably, the turf matt member 80 is secured to the insert member 50 by threaded fasteners (FIG. 22) for ease of replacement.

In yet a further embodiment of the invention, the simulated turf matt member 80 includes a first, contrasting, straight line 82 on an upwardly oriented surface of the turf matt member 80 in an extended condition. The first straight line 82 extends from an end of the matt member 80 opposite the cup and ball return insert 50 through a center of the first cup member 65*a*. Also included is second contrasting straight line 84 on an upwardly oriented surface of the turf matt member 80 in an extended condition. The second straight line 84 extends from an end of the matt member 80 opposite the cup and ball return insert 50 through a center of the second cup member 65*b*, as illustrated in FIGS. 21 and 22. The turf matt member 80 extends beyond the base portion 20 at least about nine times the length of the cup and ball return insert member 50. Most preferably, the straight lines 82, 84 are woven into the turf matt member 80 for durability. Additionally, the upwardly oriented surface of the turf matt member 80 is preferably green in color and the straight lines 82, 84 are white for ease of viewing. Further, the turf matt member 80 may include half the upwardly oriented surface in a light green and the other half of the upwardly oriented surface a dark green to simulate shade and sunlight conditions.

As mentioned above, the first cup member 65*a* has a diameter of 4.25 inches (regulation size cup) and the second cup member 65*b* has a diameter of 2.0 inches. Thus, the golfer can improve his/her putting skills by putting into the smaller diameter cup 65*b*. Likewise, the straight lines 82, 84 on the turf matt member 80 assists the golfer in aligning the putt and shows the golfer where the putt strays off line.

While the invention has been particularly shown and described with reference to preferred embodiments thereof, it will be understood by those skilled in the art that various changes in form and details may be made therein without departing from the spirit and scope of the invention.

I claim:

1. A portable golf putting practice kit comprising:

a case member including a base portion with upstanding walls and a planar bottom surface, and a cover portion hinged to the base portion, the cover portion having an exterior surface and an interior surface having a plurality of recessed storage areas adapted for holding sections of a putter golf club;

the base portion including one upstanding wall hinged at a wall base thereof, thereby allowing the hinged wall to pivot outwardly from the base portion and lie flat on a support surface;

a cup and ball return insert member contained within the base portion, the insert member including a ramp section and a planar plateau section, the ramp section having an inclined surface extending from the base of the hinged upstanding wall to the planar plateau section, the plateau section elevated above the bottom surface of the base portion and including at least two cup members, each cup member with a top opening, a sidewall and a closed bottom end, the cup members extending below the plateau section, the at least two cup members including a first cup member of selected diameter and a second cup member of diameter less than the selected diameter of the first cup member, the insert member including a ball return channel with a first section extending across the plateau section at an edge thereof opposite the ramp section of the insert member and from the plateau section to the inclined surface at the base of the hinged upstanding wall, and a ball return channel second section intersecting the first and second cup members' sidewalls thereof contained in the plateau section and connected to the first ball return section, the ball return channel sized to accept a golf ball and inclined from the plateau section toward the base of the hinged upstanding wall section, the upstanding walls of the base portion extend above the ramp section and plateau section of the cup and ball return insert member contained therein;

a planar backstop member pivotally secured to the base portion of the case member across the edge of the plateau section opposite the ramp section, the backstop member pivoting from a horizontal orientation against the plateau section to a vertical orientation perpendicular to the plateau section; and a simulated turf matt member secured to the plateau section and the ramp section of the cup and ball return insert member, the turf matt member adapted for extension over the hinged wall pivoted outwardly from the base portion and lying flat on a support surface and onto the support surface beyond the case member, the turf matt member sufficiently flexible that the rolled matt member is contained within the case member with the hinged wall member in an upright orientation and the cover portion secure to the base portion in a closed condition.

2. The portable golf putting practice kit of claim 1, wherein the at least two cup members are positioned equidistant from the wall base of the upstanding hinged wall.

3. The portable golf putting practice kit of claim 1, further including a first, contrasting, straight line on an upwardly oriented surface of the turf matt member in an extended condition, the first line extending from an end of the matt member opposite the cup and ball return insert through a center of the first cup member, and a second contrasting straight line on an upwardly oriented surface of the turf matt member in an extended condition, the second line extending from an end of the matt member opposite the cup and ball return insert through a center of the second cup member.

4. The portable golf putting practice kit of claim 1, wherein the first section of the ball return channel is open to the insert member's ramp and plateau sections and the second section of the ball return channel is covered by the turf matt member.

5. The portable golf putting practice kit of claim 1, wherein cover portion is removably hinged to the base portion.

6. The portable golf putting practice kit of claim 1, wherein the upstanding hinged wall tapers from the wall base thereof to a top edge thereof.

7. The portable golf putting practice kit of claim 1, wherein the simulated turf matt member includes a latex base layer and a synthetic fabric layer secured to one surface thereof, with a portion of the latex base layer secured to the cup and ball return insert member.

8. The portable golf putting practice kit of claim 1, wherein the simulated turf matt member extends beyond the base portion at least about nine times the length of the cup and ball return insert member.

9. A portable golf putting practice kit comprising:

a case member including a base portion with upstanding walls and a planar bottom surface, and a cover portion hinged to the base portion, the cover portion having an exterior surface and an interior surface having a plurality of recessed storage areas adapted for holding sections of a putter golf club;

a putter golf club reversibly assembled from a plurality of connectable sections, each connectable section fitting into one of the recessed storage areas of the cover portion;

the base portion including one upstanding wall hinged at a wall base thereof, the upstanding hinged wall tapering from the wall base thereof to a top edge thereof, thereby allowing the hinged wall to pivot outwardly from the base portion and lie flat on a support surface;

a cup and ball return insert member contained within the base portion, the insert member including a ramp section and a planar plateau section, the ramp section having an inclined surface extending from the base of the hinged upstanding wall to the planar plateau section, the plateau section elevated above the bottom surface of the base portion and including at least two cup members, each cup member with a top opening, a sidewall and a closed bottom end, the cup members extending below the plateau section, the at least two cup members including a first cup member of selected diameter and a second cup member of diameter less than the selected diameter of the first cup member, the insert member including a ball return channel with a first section extending across the plateau section at an edge thereof opposite the ramp section of the insert member and from the plateau section to the inclined surface at the base of the hinged upstanding wall, and a ball return channel second section intersecting the first and second cup members' sidewalls thereof contained in the plateau section and connected to the first ball return section, the ball return channel sized to accept a golf ball and inclined from the plateau section toward the base of the hinged upstanding wall section, the upstanding walls of the base portion extend above the ramp section and plateau section of the cup and ball return insert member contained therein;

a planar backstop member pivotally secured to the base portion of the case member across the edge of the plateau section opposite the ramp section, the backstop member pivoting from a horizontal orientation against the plateau section to a vertical orientation perpendicular to the plateau section; and a simulated turf matt member secured to the plateau section and the ramp section of the cup and ball return insert member, the turf matt including a first, contrasting, straight line on an upwardly oriented surface of the turf matt member in an extended condition, the first line extending from an end of the matt member opposite the cup and ball return insert through a center of the first cup member, and a second contrasting straight line on an upwardly oriented surface of the turf matt member, in an extended condition, the second line extending from an end of the matt member opposite the cup and ball return insert through a center of the second cup member, the turf matt member adapted for extension over the hinged wall pivoted outwardly from the base portion and lying flat on a support surface and onto the support surface beyond the case member, the turf matt member sufficiently flexible that the rolled matt member is contained within the case member with the hinged wall member in an upright orientation and the cover portion secure to the base portion in a closed condition.

10. The portable golf putting practice kit of claim 9, wherein the at least two cup members are positioned equidistant from the wall base of the upstanding hinged wall.

11. The portable golf putting practice kit of claim 9, wherein the first section of the ball return channel is open to the insert member's ramp and plateau sections and the second section of the ball return channel is covered by the turf matt member.

12. The portable golf putting practice kit of claim 9, wherein cover portion is removably hinged to the base portion.

13. The portable golf putting practice kit of claim 9, wherein the simulated turf matt member includes a latex base layer and a synthetic fabric layer secured to one surface thereof, with a portion of the latex base layer secured to the cup and ball return insert member.

14. The portable golf putting practice kit of claim 9, wherein the simulated turf matt member extends beyond the base portion at least about nine times the length of the cup and ball return insert member.

15. A portable golf putting practice kit comprising:

a case member including a base portion with upstanding walls and a planar bottom surface, and a cover portion hinged to the base portion, the cover portion having an exterior surface and an interior surface having a plurality of recessed storage areas adapted for holding sections of a putter golf club;

a putter golf club reversibly assembled from a plurality of connectable sections, each connectable section fitting into one of the recessed storage areas of the cover portion;

the base portion including one upstanding wall hinged at a wall base thereof, thereby allowing the hinged wall to pivot outwardly from the base portion and lie flat on a support surface;

a cup and ball return insert member contained within the base portion, the insert member including a ramp section and a planar plateau section, the ramp section having an inclined surface extending from the base of the hinged upstanding wall to the planar plateau section, the plateau section elevated above the bottom surface of the base portion and including at least two cup members, each cup member with a top opening, a sidewall and a closed bottom end, the cup members extending below the plateau section, the at least two cup members including a first cup member of selected diameter and a second cup member of diameter less than the selected diameter of the first cup member, the insert member including a ball return channel with a first section extending across the plateau section at an edge thereof opposite the ramp section of the insert member and from the plateau section to the inclined surface at the base of the hinged upstanding wall, and a ball return channel second section intersecting the first and second cup members' sidewalls thereof contained in the plateau section and connected to the first ball return section, the ball return channel sized to accept a golf ball and inclined from the plateau section toward the base of the hinged upstanding wall section, the upstanding walls of the base portion extend above the ramp section and plateau section of the cup and ball return insert member contained therein;

a planar backstop member pivotally secured to the base portion of the case member across the edge of the plateau section opposite the ramp section, the backstop member pivoting from a horizontal orientation against the plateau section to a vertical orientation perpendicular to the plateau section; and a simulated turf matt member secured to the plateau section and the ramp section of the cup and ball return insert member, the turf matt including a first, contrasting, straight line on an upwardly oriented surface of the turf matt member in an extended condition, the first line extending from an end of the matt member opposite the cup and ball return insert through a center of the first cup member, and a second contrasting straight line on an upwardly oriented surface of the turf matt member in an extended condition, the second line extending from an end of the matt member opposite the cup and ball return insert through a center of the second cup member, the turf matt member adapted for extension over the hinged wall pivoted outwardly from the base portion and lying flat on a support surface and onto the support surface beyond the case member, the turf matt member sufficiently flexible that the rolled matt member is contained within the case member with the hinged wall member in an upright orientation and the cover portion secure to the base portion in a closed condition.

16. The portable golf putting practice kit of claim 15, wherein the at least two cup members are positioned equidistant from the wall base of the upstanding hinged wall.

17. The portable golf putting practice kit of claim 15, wherein the first section of the ball return channel is open to the insert member's ramp and plateau sections and the second section of the ball return channel is covered by the turf matt member.

* * * * *